US006142798A

United States Patent [19]

Tran et al.

[11] Patent Number: 6,142,798

[45] Date of Patent: Nov. 7, 2000

[54] CAP HOUSING FOR ELECTRICAL CONNECTORS

[75] Inventors: Mai Loan Thi Tran, Harrisburg; Richard Allen Kile, Steelton, both of Pa.; Yoji Yoshimura, Yokohama; Ikuo Enomoto, Tokyo, both of Japan

[73] Assignee: The Whitaker Corporation, Wilmington, Del.

[21] Appl. No.: 09/132,152

[22] Filed: Aug. 11, 1998

[51] Int. Cl.[7] ..... H01R 13/44

[52] U.S. Cl. ..... 439/135; 439/940

[58] Field of Search ..... 439/41, 42, 135, 439/136, 247, 248, 940

[56] References Cited

U.S. PATENT DOCUMENTS 4,915,636 4/1990 Knight ..... 439/65

5,037,319 8/1991 Hatagishi ..... 439/140

5,899,760 5/1999 Ho et al. ..... 439/135

FOREIGN PATENT DOCUMENTS

WO 96/24969 8/1996 WIPO ..... H01R 23/72

WO 97/12426 4/1997 WIPO ..... H01R 13/52

*Primary Examiner*—Khiem Nguyen

*Attorney, Agent, or Firm*—Bradley N. Ditty

[57] ABSTRACT

The present invention is directed to a cap housing for carrying electrical connectors to be mounted onto solder pads or through-holes on a printed circuit board or other circuitry. The cap housing has a plurality of electrical connector receiving cavities profiled to be relatively complementary in shape and of slightly larger dimension to the exterior profile of the electrical connector received within the cap housing. A floating arrangement of the electrical connector within the cap housing is thereby created which prevents coplanarity problems which contribute to non-filled or partially filled solder joints.

13 Claims, 8 Drawing Sheets

CAP HOUSING FOR ELECTRICAL CONNECTORS

FIELD OF THE INVENTION

The invention is directed to a cap housing for mounting electrical connectors to printed circuit boards and other electronic circuitry.

BACKGROUND OF THE INVENTION

During manufacture of printed circuit boards and other electronic circuitry, connectors carrying a plurality of contacts are mounted to the circuitry by such methods as through-hole mounting and surface mount technology. Typically, it is desirable to robotically place connector housings to a printed circuit board by aligning contact tines with through-holes or on to the solder pads of the printed circuit board before soldering thereto. The contact tines of the contacts within the connector housing are subsequently soldered to the board, resulting in a connector half which is prepared to receive a complimentary mating connector.

During this assembly process, it is important to ensure that the contact portions of the connector housing which will be mating with the complimentary connector are protected from damage and free from any dust or foreign debris. Consequently, covers or cap housings may be employed to carry the connectors and protect the contacts.

Also, as these connector housings are typically robotically placed on the printed circuit boards, it is an advantage to align and place more than one connector housing on the board at the same time. Accordingly, cap housings have been designed to carry more than one connector housing at once.

While carrying multiple connector housings and placing them on a printed circuit at one time provides the obvious advantage of reducing assembly time, the disadvantage of coplanarity problems may lead to non-filled or partially-filled soldered joints.

Often, multiple connectors are positioned onto a printed circuit board in extremely tight quarters which requires placement within very narrow tolerances. Thus, where the surface of a printed circuit board may be characterized as extending in the x- and y-direction and the z-direction extends perpendicularly to the board surface, connectors must be placed onto the board in such a way that the connectors adhere strictly to x- and y-direction location requirements while accommodating irregularities in the topography of the board which affect seating in the z-direction. When multiple connectors are carried by one cap housing and are placed on a board simultaneously, each connector encounters minor variations in the topography of the board which may not be encountered by the other connector or connectors carried by the same cap housing. However, since the connectors are rigidly held within the cap housing, the seating of one connector in the z-direction will be identically repeated by all other connectors carried by the cap housing. It is this coplanarity problem that leads to unreliable solder joints. As such, it would be desirable to provide a cap housing which carries and protects multiple connector housings, allowing their simultaneous installation onto a printed circuit board or electronic circuitry while allowing each connector to float within the cap housing and individually self-level on the board, thereby avoiding coplanarity problems.

SUMMARY OF THE INVENTION

Accordingly, it is an object of the present invention to provide a cap housing for carrying multiple connector housings which will allow each connector housing to float and find its home on the PC board thereby precluding non-filled or partially filled soldered joints by eliminating coplanarity problems.

In accordance with the teachings of the present invention, there is provided a cap housing to which an electrical connector may be mounted for positioning tine portions of electrical contacts secured within the electrical connector onto solder pads of circuit boards. The cap housing has a cap portion in which a mating section of the electrical connector containing contact portions may be received. The cap portion has an interior profile complimentary to the profile of the mating section of the electrical connector. The interior profile is of slightly larger dimension than the profile of the mating section thereby facilitating a floating fit between the cap portion and the mating section. At least one contact surface is provided on the cap portion for receiving at least one complimentary contact area of the mating section. And, a retention means is provided for loosely retaining an electrical connector within the cap housing.

BRIEF DESCRIPTION OF THE DRAWINGS

An embodiment of the present invention will now be described in detail with reference to the accompanying drawings, in which.

DESCRIPTION OF THE INVENTION

Figure 1:
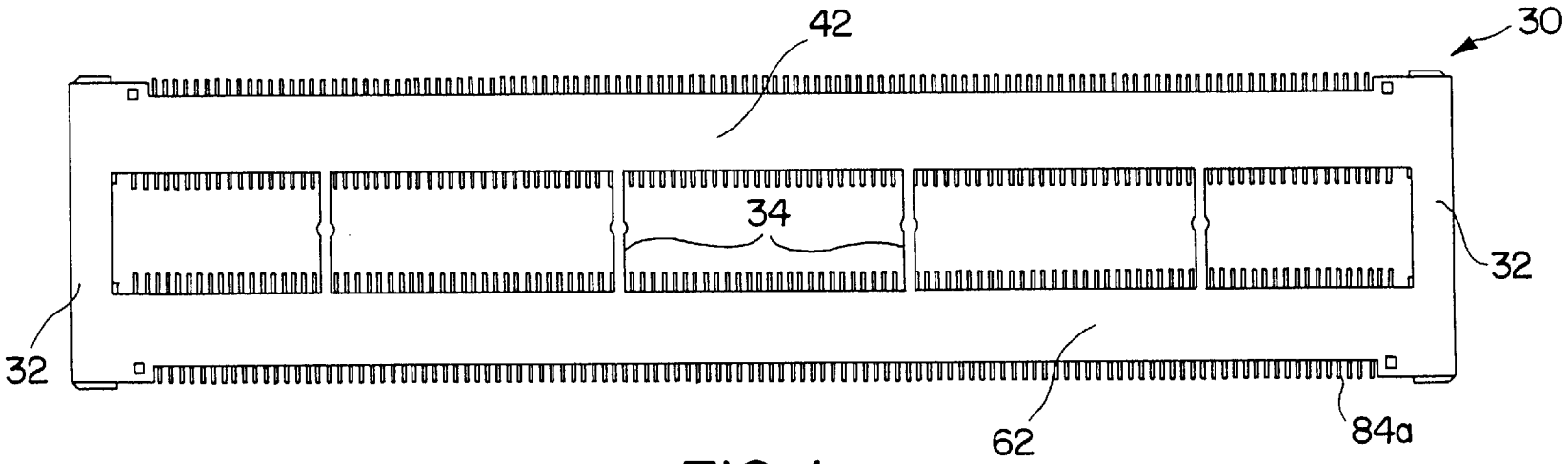
FIG. 1 PRIOR ART
FIG. 1 is a top view of a prior art cap housing loaded with a plurality of electrical connectors.
Figure 2:
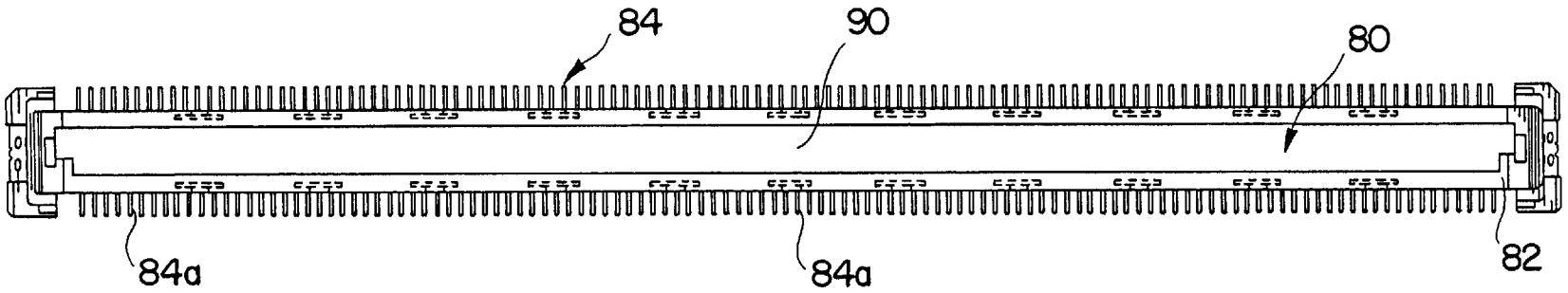
FIG. 2 PRIOR ART
FIG. 2 is a top view of a prior art electrical connector.
Figure 3:
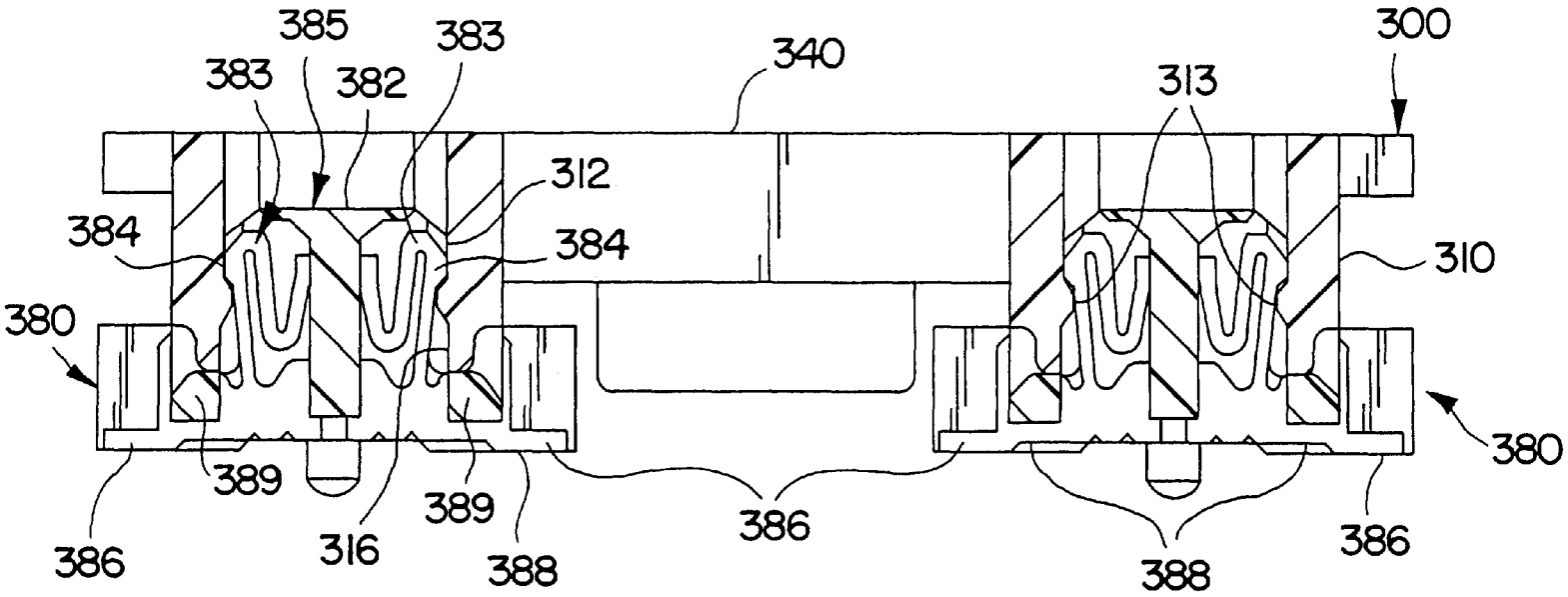
FIG. 3 PRIOR ART
FIG. 3 is a cross sectional view of a prior art cap housing loaded with a plurality of electrical connectors.
Figure 4:
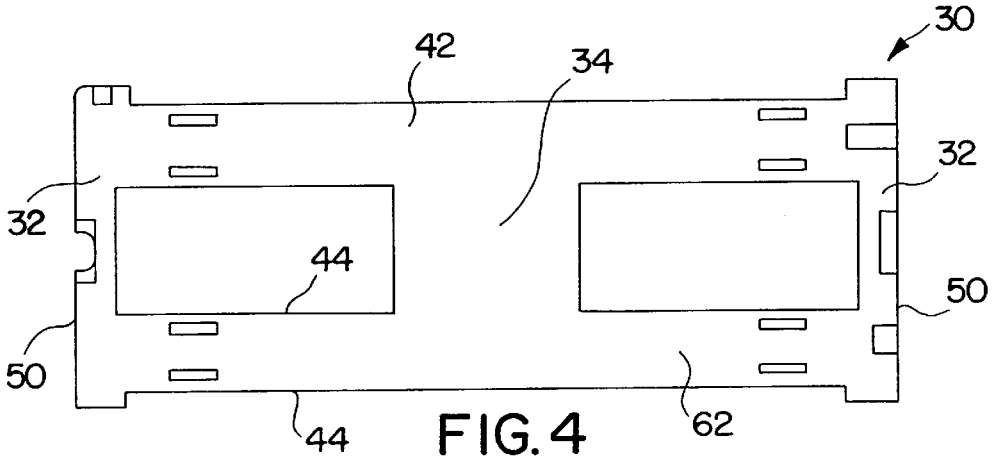
FIG. 4 is a top view of the cap housing of the present invention.

FIG. 1 illustrates a known cap housing (30) for carrying electrical connectors (80), as shown in prior art FIG. 2. Prior art FIG. 3 is a cross-sectional view of a known cap housing (300) carrying electrical connectors (380). As shown, each electrical connector (380) is rigidly retained in cap housing (300). Top portion (382) is firmly fitted against mating sections (385) of both electrical connectors (380). Contact portions (384) are likewise firmly seated against side walls (312) and retained by engagement projections (313). Finally, side walls (312) terminate at end portions (316) which snuggly abut base portions (389) of electrical connectors (380). As such, movement of electrical connectors (380) with respect to cap housing (300) in both horizontal and vertical directions is precluded. And, consequently, minor rotational adjustments of electrical connectors (380) are impossible during placement and installation of the assembly on circuit boards. FIG. 4 shows a top view of the cap housing (30) of the present invention. Cap housing (30) is comprised of a plurality of elongated upper walls (42), (62) which are connected by transverse ribs (32) disposed at each end of upper walls (42),(62). Center rib (34) spans between upper walls (42), (62) adding greater strength and rigidity to cap housing (30).

Figure 5:
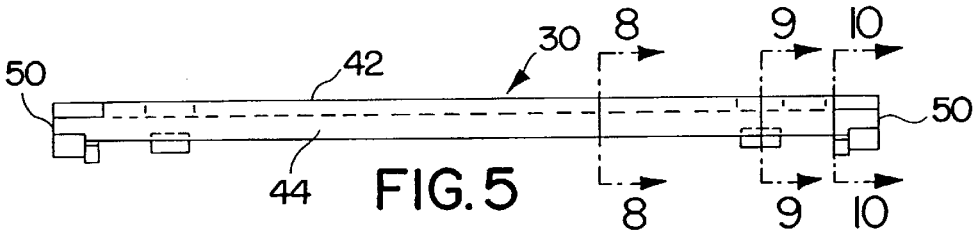
FIG. 5 is a side view of the cap housing of the present invention.
Figure 6:
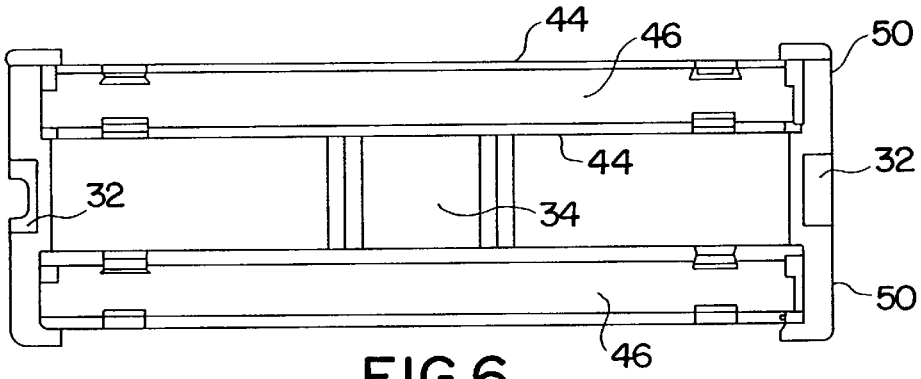
FIG. 6 is a bottom view of the cap housing of the present invention.

FIG. 5 shows a side view of cap housing (30). As shown, upper wall (42) is terminated at each end by downwardly extending end walls (50). Side walls (44) extend the length of upper wall (42) between end walls (50) thereby defining electrical connector receiving cavities (46), as best shown in FIG. 6.

Figure 7:
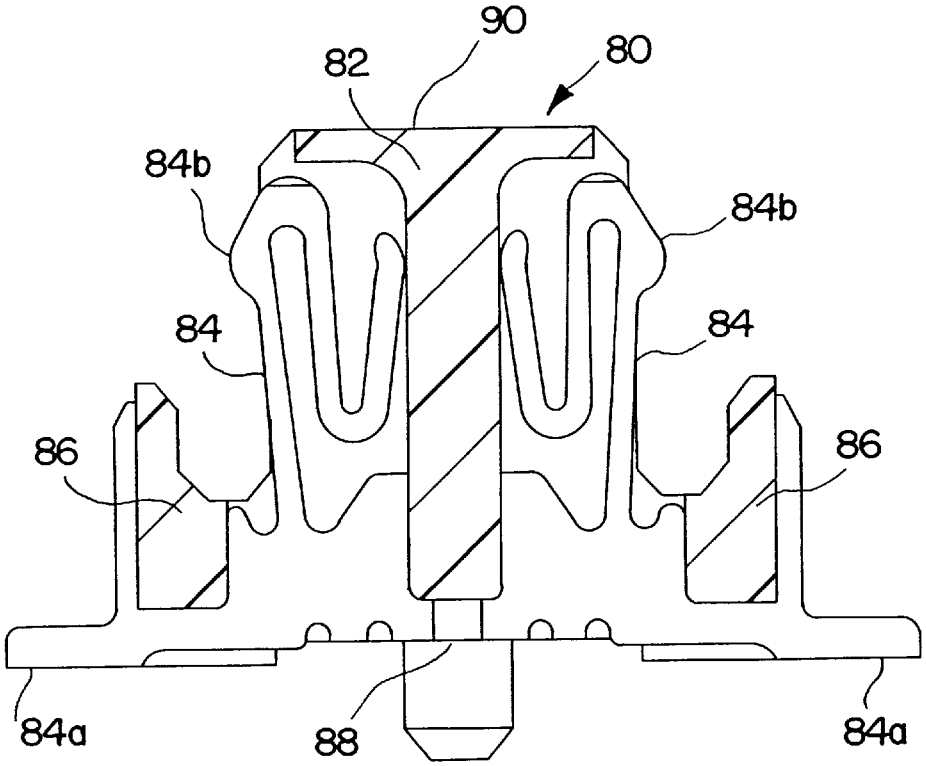
FIG. 7 is a cross sectional end view of an electrical connector which is receivable in the cap housing of the present invention.

A cross-sectional end view of electrical connector (80) is shown in FIG. 7. A connector (80) is made up of electrical connector housing (82) which has a top surface (90) and bottom surface (88). A plurality of electrical contacts (84) are housed within electrical connector housing (82) and have electrical contact portions (84*b*) for electrically mating with a complimentary electrical connector (not shown) and contact time portions (84*a*) for mounting on solder pads of printed circuit boards or other electronic circuitry.

Figure 8:
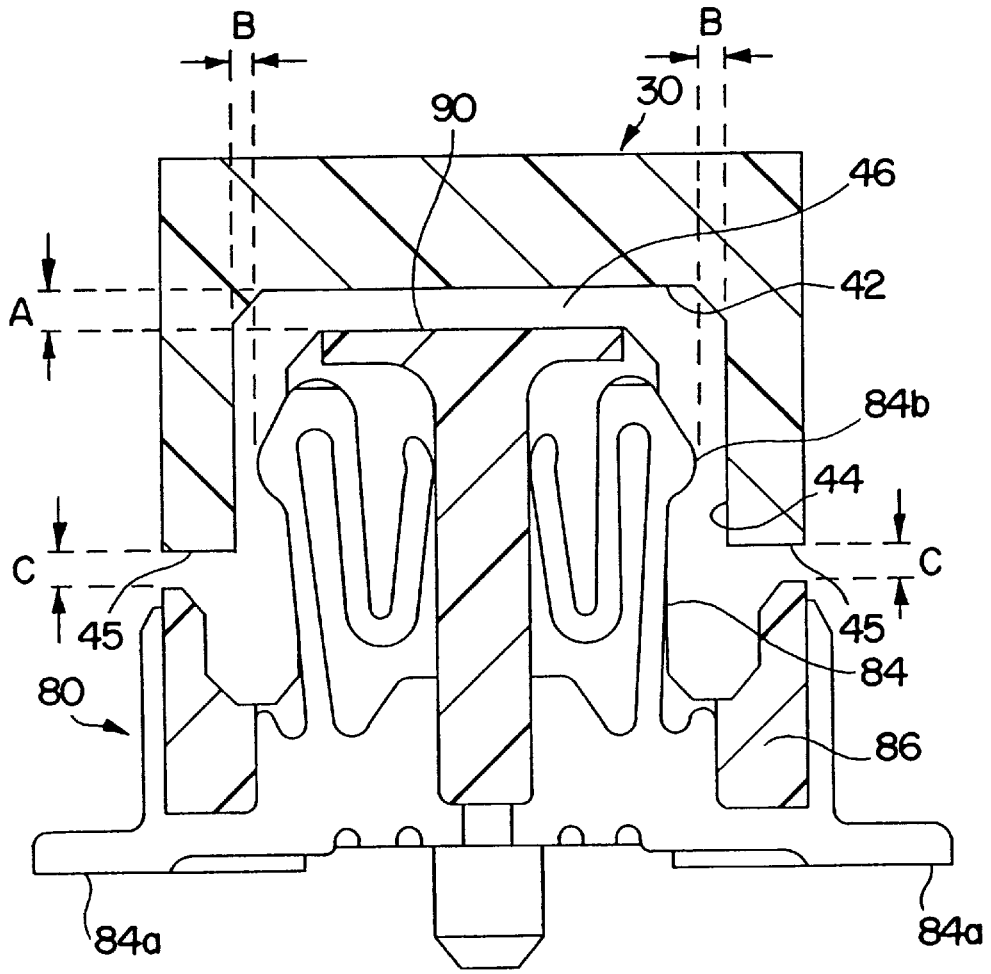
FIGS. 8–10 are cross sectional end views of the electrical connector of FIG. 7 loaded within one of the electrical connector receiving cavities of the cap housing of the present invention.

In contrast to the electrical connector and cap housing configuration of prior art FIG. 3, FIG. 8 shows a cross-sectional end view taken from FIG. 5 of one electrical connector receiving cavity (46) of the cap housing (30) of the present invention loaded with electrical connector (80) in a floating arrangement. As shown, numerous clearances are provided by the cap housing (30) which provides a relatively larger dimensioned electrical connector receiving cavity (46) than the dimensions of electrical connector (80). Clearance "A", which is shown as the distance between upper wall (42) and top surface (90), allows electrical connector (80) to adjust in a vertical direction. Clearances "B", shown as the distance between side walls (44) and electrical contact portions (84*b*), prevent contacts (84) from putting too much pressure on cap housing side wall (44), thereby allowing the electrical connector (80) to adjust itself in a horizontal direction. Clearances "C" are shown as the distance between electrical connector housing legs (86) and side wall bottom surfaces (45). Clearances "C" provide similar advantages as clearances "B" with the added benefit of preventing stubbing between the cap housing (30) and the electrical connector (80) which could otherwise lead to skewing of the electrical connector with respect to the solder pads on a printed circuit board.

Figure 9:
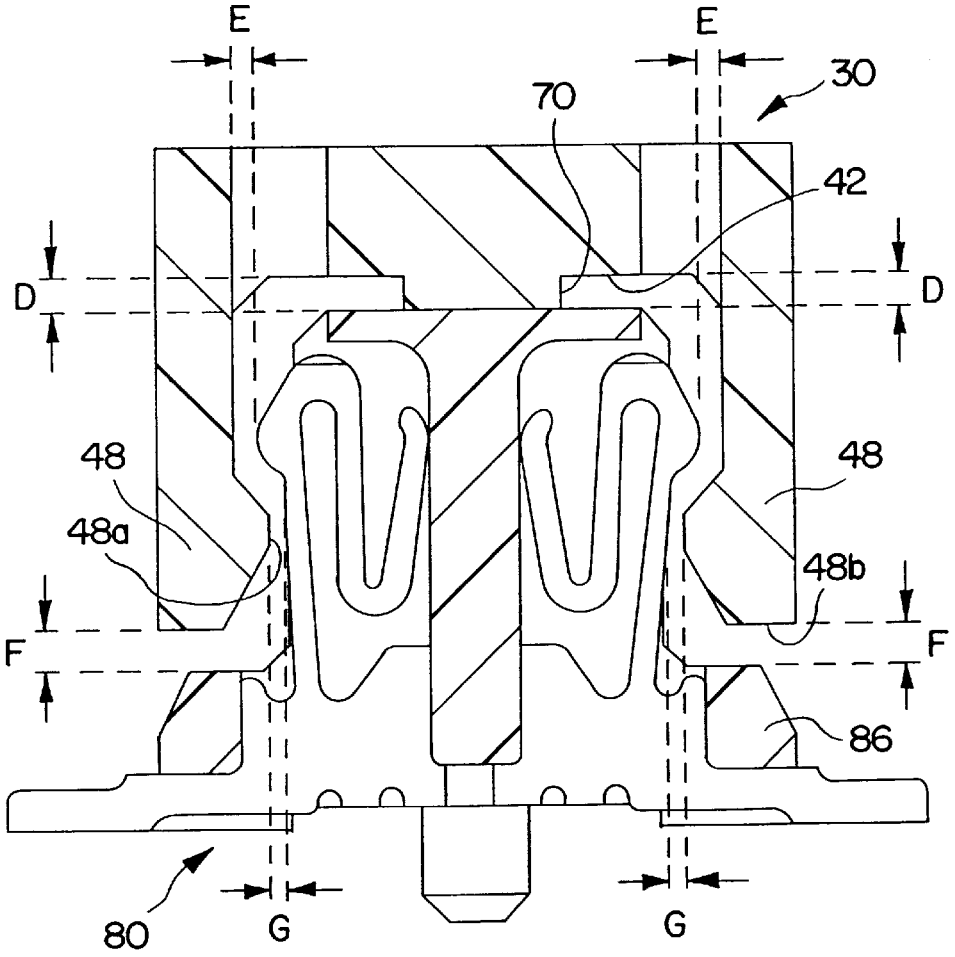

FIG. 9 shows a cross-sectional view of electrical connector receiving cavity (46) of cap housing (30) loaded with electrical connector (80) as taken from FIG. 5. As shown, side walls (44) further comprise resilient arms (48) which have inward projections (48*a*) for loosely engaging contact portions (84*b*). Upper wall (42) features a downwardly extending stand-off surface, or platform (70), which rests atop top surface (90) of electrical connector (80). As FIG. 9 illustrates, clearances are still provided between the housing (30) and electrical connector (80) thereby maintaining a floating condition. Specifically, clearances "D", which indicate the distance between upper wall (42) and top surface (90), allow cap housing (30) to slightly teeter upon electrical connector (80). Similarly, clearances "E", which indicate the distance between side wall (44) and contacts (84), provide horizontal freedom of the electrical connector within the cap housing. Clearances "F", which represents the distance between the bottoms of resilient arms (48*b*) and electrical housing legs (86) provide the same benefits as clearance "C", shown in FIG. 8. Clearances "G", which represents the distance between resilient arm projections (48*a*) and contact portions (84*b*), although tighter than clearance "E", still provide an advantageous degree of freedom which will permit electrical connector (80) to float within cap housing (30) both horizontally and in a rocking motion.

Figure 10:
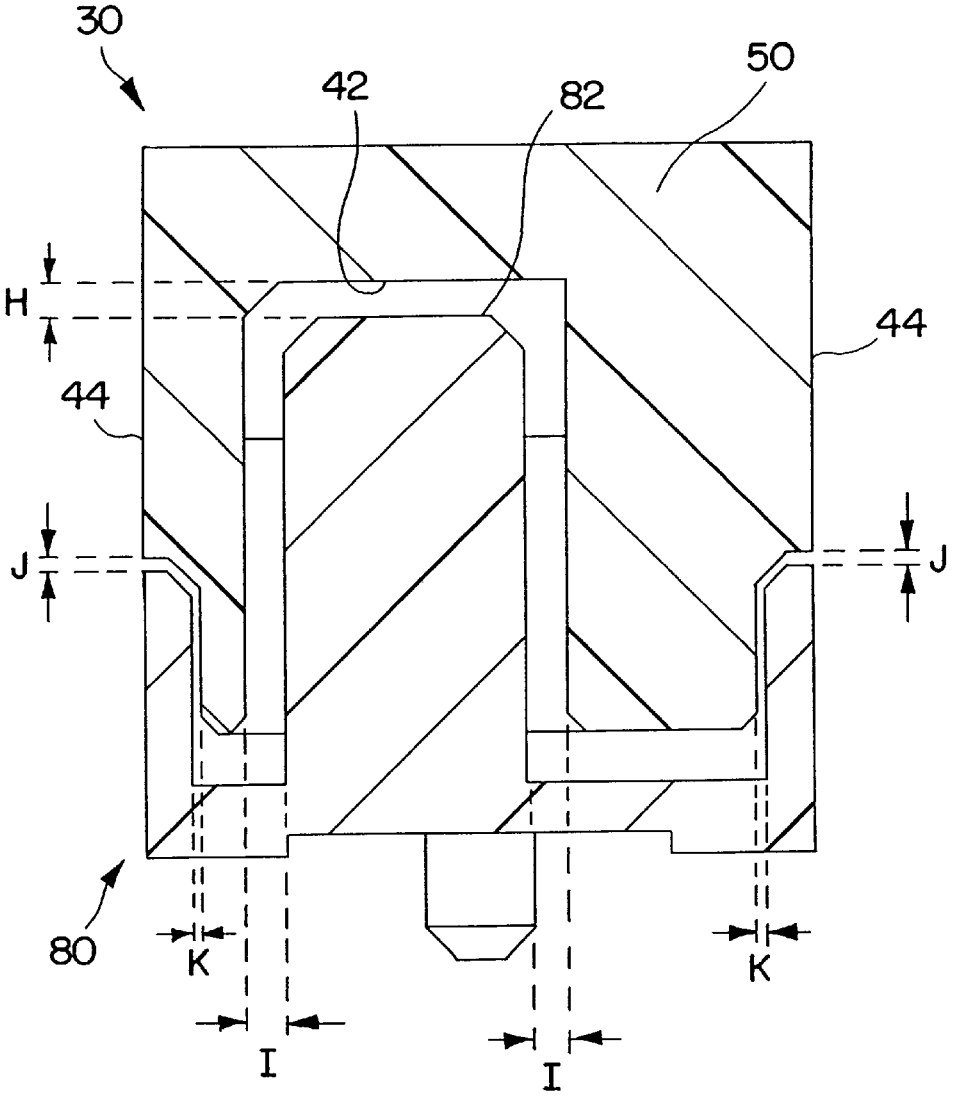

FIG. 10 is a cross-sectional view taken near an end of cap housing (30) as indicated in FIG. 5, showing one electrical connector receiving cavity (46) of the cap housing (30) loaded with electrical connector (80). Clearance "H" again shows the distance between upper wall (42) and top surface (90) and is maintained by platform (70) as shown in FIG. 9. Clearances "I" indicate the distance between side walls (44) and electrical connector housing (82), and again provide horizontal and rotational freedom of the electrical connector (80) within cap housing (30). Clearances "J" and "K" represent distances between side walls (44) and housing legs (86) and provide respectively, vertical and horizontal freedom of the electrical connector while preventing stubbing between the cap housing and the connector housing.

It is important to note that although clearances B, C, E, F, I and K all provide horizontal freedom of the connector within the housing, these horizontal clearances are provided primarily to facilitate rotational movement of the connector and only a minor degree of actual horizontal motion within the housing. In no event should these clearances allow enough horizontal freedom to negatively affect alignment of the connectors onto the printed circuit board or other electronic circuitry.

Accordingly, a cap housing and an electrical connector configuration is provided which allows the electrical connector to be carried to and placed on a printed circuit board or other electronic circuitry while protecting contact surfaces from dust and other foreign debris and permitting the electrical connector to adjust itself on the board thereby finding its own home. By providing the floating connector and cap housing arrangement, an electrical connector can compensate for irregularities in the topography of a printed circuit board or other electronic circuitry and ensure that contact tines will be best seated on to solder pads or into through-holes of the circuitry. This feature provides the benefit of eliminating coplanarity problems thereby precluding non-filled or partially filled solder joints.

It should be understood from the foregoing description that numerous electrical connector cross-sectional configurations may be accommodated by a relatively complimentary cap housing of slightly larger dimension. For instance, provided adequate clearances are maintained between a cap housing and a connector in both horizontal and vertical directions, an electrical connector will be permitted to float within the cap housing and adjust itself on a printed circuit board or electronic circuitry during placement and installation.

Furthermore, various retention means may be employed to loosely secure the electrical connector within the cap housing during pick and place assembly of electronic equipment. For instance, an alternative to the resilient arms (48) would be to provide projections on the outer surface of side walls (44) which could be engaged by upwardly extending resilient arms on an electrical connector.

Also, various configurations may be employed to replicate the function of platform (70) as illustrated in FIG. 9. For instance, a connector may already provide a plurality of pedestals extending upwardly from top surface (90) thereby eliminating any need for platform (70). Furthermore, upper wall (42) and top surface (90) may employ a plurality of opposing platform surfaces which would perform the same function as platform (70).

Finally, various arrangements of multiple connectors held within corresponding cap portions may be easily adapted by the teachings of the present invention. For instance, several electrical connectors could be carried in parallel by a cap housing having parallel cap portions. Similarly, square configurations or a grid-work of electrical connectors could be carried by a cap housing having cap portions arranged in a complementary fashion. A square configuration would merely have four cap portions arranged at right angles to each other and connected by corner portions, rather than transverse ribs or end walls. Indeed, any combination of parallel or square arrangements could be employed concurrently.

It is therefore apparent that various changes may be made in the form, construction, and arrangement of parts thereof without departing from the spirit of the invention, or sacrificing all of its material advantages. Thus, while a present embodiment of the invention has been disclosed, it is to be understood that the invention is not strictly limited to such embodiment but may be otherwise variously embodied and practiced within the scope of the appended claims.

We claim:

1. A cap housing to which an electrical connector may be mounted for positioning time portions of electrical contacts secured within the electrical connector onto solder pads of circuit boards, comprising:

a cap portion in which a mating section of the electrical connector containing contact portions may be received, the cap portion having an interior profile complementary to the profile of the mating section of the electrical connector, wherein the interior profile is of slightly larger dimension than the profile of the mating section thereby facilitating a floating fit between the cap portion and the mating section;

at least one stand-off surface located on the cap portion for engaging a surface of the mating section; and a retention means for loosely retaining the electrical connector within the cap housing.

2. The cap housing of claim 1, wherein the surface of the mating section has a pedestal to correspond to each stand-off surface and the stand-off surface of the cap portion is a flat platform which rests atop the pedestal.

3. The cap housing of claim 1, wherein the stand-off surface is a cylindrical platform extending downward from the cap housing which engages the surface of the mating section.

4. The cap housing of claim 1, wherein the retention means is a plurality of opposed projections located on the interior profile, projecting inwardly toward the mating section and loosely engaging the mating section when fitted within the cap housing.

5. The cap housing of claim 1, wherein the retention means is a plurality of latch arms located on the cap portion and extending downwardly to loosely engage complementary latch projections on the electrical connector.

6. The cap housing of claim 1, wherein the retention means is a plurality of projections on the cap portion located to receive upwardly extending latch arms located on the electrical connector.

7. A cap housing to which a plurality of electrical connectors may be mounted for positioning time portions of electrical contacts secured within the electrical connectors onto solder pads of circuit boards, comprising:

a plurality of cap portions into which mating sections of electrical connectors containing contact portions may be received, each cap portion having an interior profile complementary to the profile of the mating section of the electrical connector, wherein the interior profile is of slightly larger dimension than the profile of the mating section thereby facilitating a floating fit between each cap portion and each mating section;

at least one stand-off surface located on each cap portion for engaging a surface of each mating section; and a retention means for loosely retaining each electrical connector within each cap portion.

8. The cap housing of claim 7, wherein the cap portions are parallel and connected by end portions which are transverse the cap portions.

9. The cap housing of claim 8, wherein the cap portions are elongated between the end portions.

10. The cap housing of claim 9, wherein the stand-off surfaces of each cap portion are located proximate the end portions.

11. The cap housing of claim 9, wherein one stand-off surface is provided for each cap portion and is located intermediate the end portions.

12. The cap housing of claim 7, having four cap portions arranged in a square configuration and connected by corner portions.

13. A cap housing for holding at least one electrical connector to be placed onto a circuit board, comprising:

a cap portion for each electrical connector, each cap portion having an interior surface profiled to complement an exterior surface of each electrical connector, wherein the profile of each interior surface is dimensioned slightly larger than the profile of the exterior surface of each electrical connector such that each electrical connector floats within each corresponding cap portion when loaded in the cap housing;

at least one stand-off surface disposed within each cap portion to engage a top surface of each electrical connector; and a retention means disposed on each cap portion for retaining each electrical connector within each corresponding cap portion.

* * * * *